US011029115B2

(12) United States Patent
Serbu

(10) Patent No.: US 11,029,115 B2
(45) Date of Patent: Jun. 8, 2021

(54) FIRING PIN RETAINER AND FIREARM OPERATING SYSTEM INCLUDING SAME

(71) Applicant: Mark Serbu, Tampa, FL (US)

(72) Inventor: Mark Serbu, Tampa, FL (US)

(73) Assignee: Serbu Firearms, Inc., Tampa, FL (US)

( * ) Notice: Subject to any disclaimer, the term of this patent is extended or adjusted under 35 U.S.C. 154(b) by 0 days.

(21) Appl. No.: 16/681,388

(22) Filed: Nov. 12, 2019

(65) Prior Publication Data

US 2020/0240734 A1 Jul. 30, 2020

Related U.S. Application Data

(60) Provisional application No. 62/760,246, filed on Nov. 13, 2018.

(51) Int. Cl.

| | |
|---|---|
| ***F41A 19/13*** | (2006.01) |
| ***F41A 3/26*** | (2006.01) |
| ***F41A 5/18*** | (2006.01) |

(52) U.S. Cl.

CPC ..... *F41A 19/13* (2013.01); *F41A 3/26* (2013.01); *F41A 5/18* (2013.01)

(58) Field of Classification Search

CPC .... F41A 19/13; F41A 3/26; F41A 5/18; F41A 5/20; F41A 5/22

USPC ..... 89/191.01, 191.02, 192, 193

See application file for complete search history.

(56) References Cited

U.S. PATENT DOCUMENTS

| | | | | |
|---|---|---|---|---|
| 4,212,227 | A * | 7/1980 | Stewart | F41A 19/02 89/129.02 |
| 4,475,438 | A * | 10/1984 | Sullivan | F41A 5/18 89/185 |
| 9,683,800 | B2 * | 6/2017 | Sewell, Jr. | F41A 5/26 |
| 10,386,137 | B2 * | 8/2019 | Steimke | F41A 17/64 |
| 2014/0090283 | A1 * | 4/2014 | Gomez | F41A 15/14 42/25 |
| 2015/0267984 | A1 * | 9/2015 | Kokinis | F41A 5/26 42/14 |
| 2016/0047612 | A1 * | 2/2016 | Sullivan | F41A 5/28 89/191.01 |
| 2018/0164057 | A1 * | 6/2018 | Steimke | F41A 3/30 |
| 2018/0356171 | A1 * | 12/2018 | Brown | F41A 3/26 |
| 2019/0195581 | A1 * | 6/2019 | Cassels | F41A 15/16 |
| 2019/0383572 | A1 * | 12/2019 | Gregorich | F41A 3/66 |
| 2020/0033079 | A1 * | 1/2020 | Steimke | F41A 17/64 |
| 2020/0033085 | A1 * | 1/2020 | Robinson | F41A 5/28 |
| 2020/0124366 | A1 * | 4/2020 | Zuev | F41A 9/67 |

* cited by examiner

*Primary Examiner* — Joshua E Freeman

(74) *Attorney, Agent, or Firm* — Foley & Lardner LLP

(57) ABSTRACT

A firearm operating system includes a firing pin having a first end and a second end. An operating rod assembly includes an operating rod, a lug positioned at a first end of the operating rod, and a firing pin retainer extending from the lug. A bolt carrier includes a bolt carrier pocket structured to receive the firing pin retainer, and a bolt carrier cam pin opening. A bolt is structured to be received in the bolt carrier. The bolt includes a bolt cam pin opening. A cam pin is structured to be positioned through the bolt carrier cam pin opening and into the bolt cam pin opening. The first end of the firing pin extends through a firing pin opening of the cam pin to retain the cam pin. The firing pin retainer of the operating rod assembly engages the second end of the firing pin so as to retain the firing pin.

10 Claims, 3 Drawing Sheets

FIRING PIN RETAINER AND FIREARM OPERATING SYSTEM INCLUDING SAME

CROSS-REFERENCE TO RELATED APPLICATION

This application claims the benefit of and priority to U.S. Provisional Application No. 62/760,246, filed on Nov. 13, 2018, the content of which is herein incorporated by reference in its entirety.

TECHNICAL FIELD

The present disclosure relates generally to firearms.

BACKGROUND

Certain firearms include an upper receiver (e.g., a continuous aluminum extrusion, folded sheet metal, tube, casting, etc.) that houses the recoiling parts, barrel, charging handle, and possibly lugs, which allow it to fasten to a lower receiver or trigger group. Some firearms, such as those with piston-type gas operated autoloading systems, include an operating rod that attaches to a bolt carrier by a lug received in a pocket of the bolt carrier.

Gas operated autoloading systems are known for cycling the action in auto-loading semi-automatic and automatic rifles. Gas operated autoloading systems use a portion of the high energy combustion gases from discharging the firearm to cycle the action for extracting a spent cartridge case and chambering a new round. After the firearm has been fired, the exhaust gases act on and move a piston and an operating rod that is operatively connected to the bolt carrier. The movement of the operating rod moves the bolt carrier rearward (in the direction opposite to the fired bullet) and to a retracted position. Once the piston has traveled a certain distance, a spring acting on the assembly will then move the operating rod and accompanying bolt carrier forward, picking up a new cartridge, and moving that cartridge into the battery position.

SUMMARY

Various embodiments relate to a firearm operating system. An example firearm operating system includes a firing pin having a first end and a second end. An operating rod assembly includes an operating rod, a lug positioned at a first end of the operating rod, and a firing pin retainer extending from the lug. A bolt carrier includes a bolt carrier pocket structured to receive the firing pin retainer of the operating rod assembly, and a bolt carrier cam pin opening. A bolt is structured to be received in the bolt carrier. The bolt includes a bolt cam pin opening. A cam pin includes a firing pin opening. The cam pin is structured to be positioned through the bolt carrier cam pin opening and into the bolt cam pin opening. The first end of the firing pin extends through the firing pin opening of the cam pin to retain the cam pin. The firing pin retainer of the operating rod assembly engages the second end of the firing pin so as to retain the firing pin. A chambered round is fired in response to a hammer striking the firing pin.

Various other embodiments relate to a firearm operating system. An example firearm operating system includes a firing pin having a first end and a second end. An operating rod assembly includes an operating rod, and a lug positioned at a first end of the operating rod. A bolt includes a bolt pocket structured to receive the lug of the operating rod assembly. The lug engages a firing pin retainer located at the second end of the firing pin so as to retain the firing pin. A chambered round is fired in response to the operating rod driving the firing pin forward.

Various additional embodiments relate to a firearm operating system. An example firearm operating system includes a firing pin comprising a first end and a second end. An operating rod assembly includes an operating rod and a tail extending below a first end. A bolt carrier defines a recess and a slot, the slot being positioned transverse to the recess, the recess configured to receive the tail. An elongate firing pin retainer is sized to be slidably received by the slot, and the tail contacts the elongate firing pin retainer when the recess receives the tail. The elongate firing pin retainer engages the second end of the firing pin so as to retain the firing pin.

This summary is illustrative only and is not intended to be in any way limiting. Other aspects, inventive features, and advantages of the devices and/or processes described herein, as defined solely by the claims, will become apparent in the detailed description set forth herein, taken in conjunction with the accompanying figures, wherein like reference numerals refer to like elements.

DETAILED DESCRIPTION

Before turning to the figures, which illustrate the exemplary embodiments in detail, it should be understood that the present disclosure is not limited to the details or methodology set forth in the description or illustrated in the figures. It should also be understood that the terminology used herein is for the purpose of description only and should not be regarded as limiting.

Figure 1:
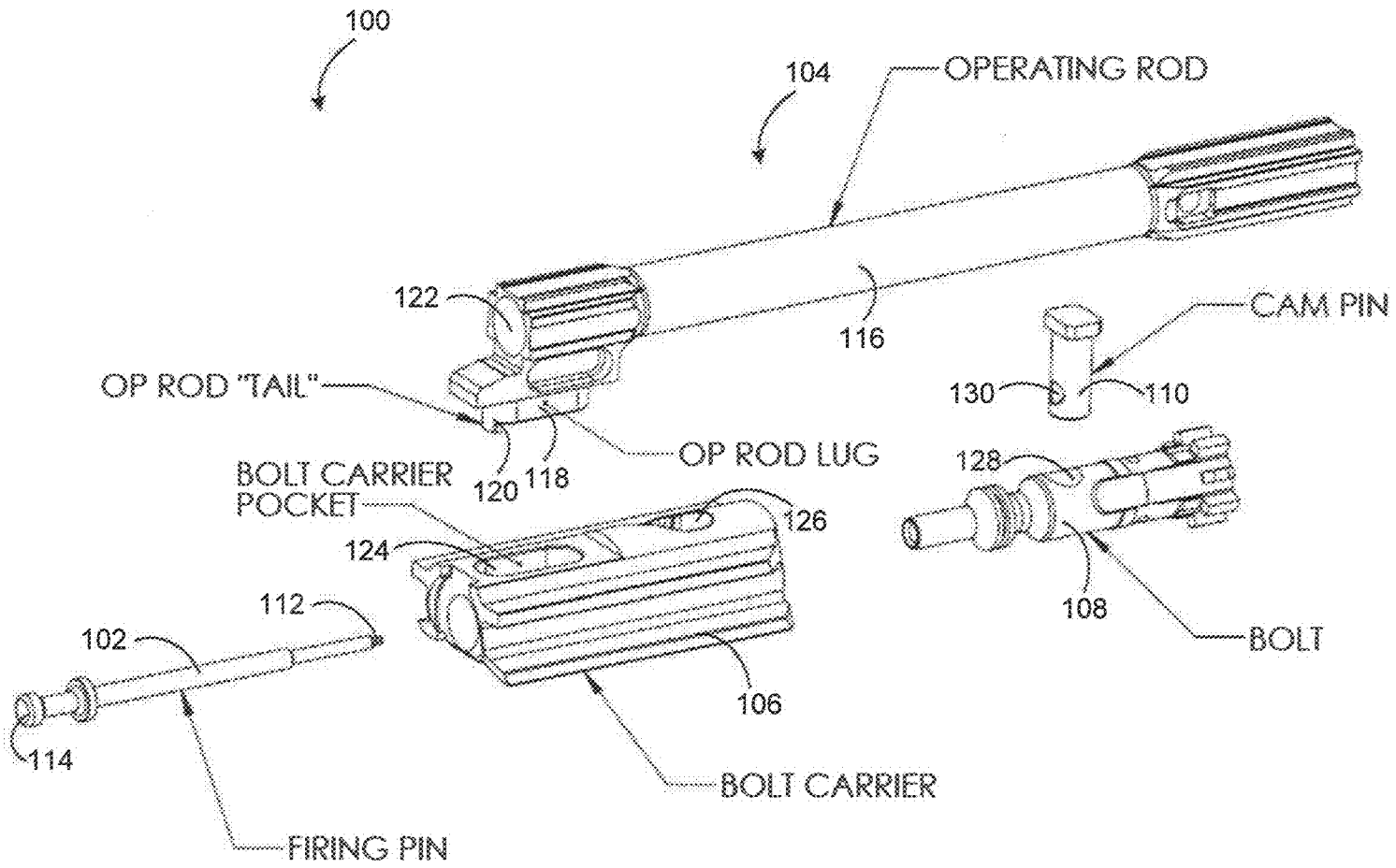
FIG. 1 is an exploded view of a firearm gas operated autoloading system 100, according to an embodiment.

FIG. 1 is an exploded view of a firearm gas operated autoloading system 100, according to an embodiment. The gas operated autoloading system 100 comprises a firing pin 102, an operating rod assembly 104, a bolt carrier 106, a bolt 108, and a cam pin 110.

The firing pin 102 comprises a first end 112 and a second end 114.

The operating rod assembly 104 comprises an operating rod 116, a lug 118, and a firing pin retainer 120. The lug 118 is positioned at a first end 122 of the operating rod 116. The firing pin retainer 120 extends from the lug 118. In some implementations, the lug 118 itself operates as the firing pin retainer 120.

The bolt carrier 106 comprises a bolt carrier pocket 124 and a bolt carrier cam pin opening 126. The bolt carrier pocket 124 is structured to receive the firing pin retainer 120 of the operating rod assembly 104. The firing pin retainer 120 extends through the bolt carrier pocket 124.

The bolt 108 comprises a bolt cam pin opening 128. The bolt 108 is structured to be received in the bolt carrier 106.

The cam pin 110 comprises a firing pin opening 130. The cam pin 110 is structured to be positioned through the bolt carrier cam pin opening 126 and into the bolt cam pin opening 128.

The first end 112 of the firing pin 102 extends through the firing pin opening 130 of the cam pin 110 to retain the cam pin 110. The firing pin retainer 120 of the operating rod assembly 104 engages the second end 114 of the firing pin 102 so as to retain the firing pin 102.

Other firearms use pins, levers or other mechanisms that require manipulation to remove the firing pin 102 from the recoiling parts of the firearm gas operated autoloading system 100. According to various embodiments, and as illustrated in FIG. 1, the cam pin 110, which is inserted into the bolt cam pin opening 128 of the bolt 108, keeps the bolt 108 in place. The firing pin 102, which passes through the firing pin opening 130 of the cam pin 110, keeps the cam pin 110 in place. Thus, a firearm implementing the firearm gas operated autoloading system 100 enables separation of the upper and lower receiver and removal of the recoiling parts out of the back of the upper receiver. The recoiling parts all come apart in seconds without any tools or any further manipulation of pins, levers, etc. The same benefit is provided when the firearm gas operated autoloading system 100 is used with guns that have a receiver and a trigger group (e.g., M-60, M-240, M-249, etc.) rather than separate upper and lower receivers.

Various embodiments described herein are directed to firearms in which a chambered round is fired in response to a hammer (not shown) striking the firing pin 102. As noted above, the firearm gas operated autoloading system 100 is structured such that the firing pin retainer 120 of the operating rod assembly 104 operates to retain the firing pin 102, thereby eliminating the need for pins, levers, or other mechanisms to retain the firing pin 102, as with existing systems. The firing pin retainer 120 is structured so as to not interfere with the operation of the hammer to strike the firing pin to fire a round.

Various other embodiments described herein are directed to other types of firearms (e.g., M-60, M-240, M-249, etc.) in which a chambered round is fired in response to the operating rod 116 driving the firing pin 102 forward. These types of firearms typically include pins or caps to retain the firing pin. In contrast, various embodiments structured for use with firearms in which the operating rod 116 drives the firing pin 102 forward to fire the firearm do not include such pins or caps, but instead utilize the firing pin retainer 120 of the operating rod assembly 104 to retain the firing pin 102.

In various other embodiments described herein, the operating rod 116 is not inserted into the bolt carrier 106, but instead interfaces with the bolt carrier 106 in a different way. For example, the bolt carrier 106 may be slidably received by the operating rod 116 (e.g., the bolt carrier may include an operating rod cavity sized to receive the operating rod), the bolt carrier may include other structures to contact and interface with the operating rod 116, etc. In such embodiments, the firing pin retainer 120 is movable and therefore must be actuated to function properly. Such actuation can occur when the operating rod 116 and the bolt carrier 106 interface with each other. In embodiments where the firing pin retainer 120 is movable, the firing pin retainer 120 may be held in the bolt carrier 106 or the operating rod 116 by a variety of different holding mechanisms (e.g., pins, screws, detents, snap-fit, etc.). During actuation, the firing pin retainer 120 can translate relative to the operating rod 116 (e.g., the firing pin retainer 120 can move forward or rearward along a longitudinal axis of the operating rod). As another example, the firing pin retainer 120 can rotate relative to the operating rod 116.

Figure 2:
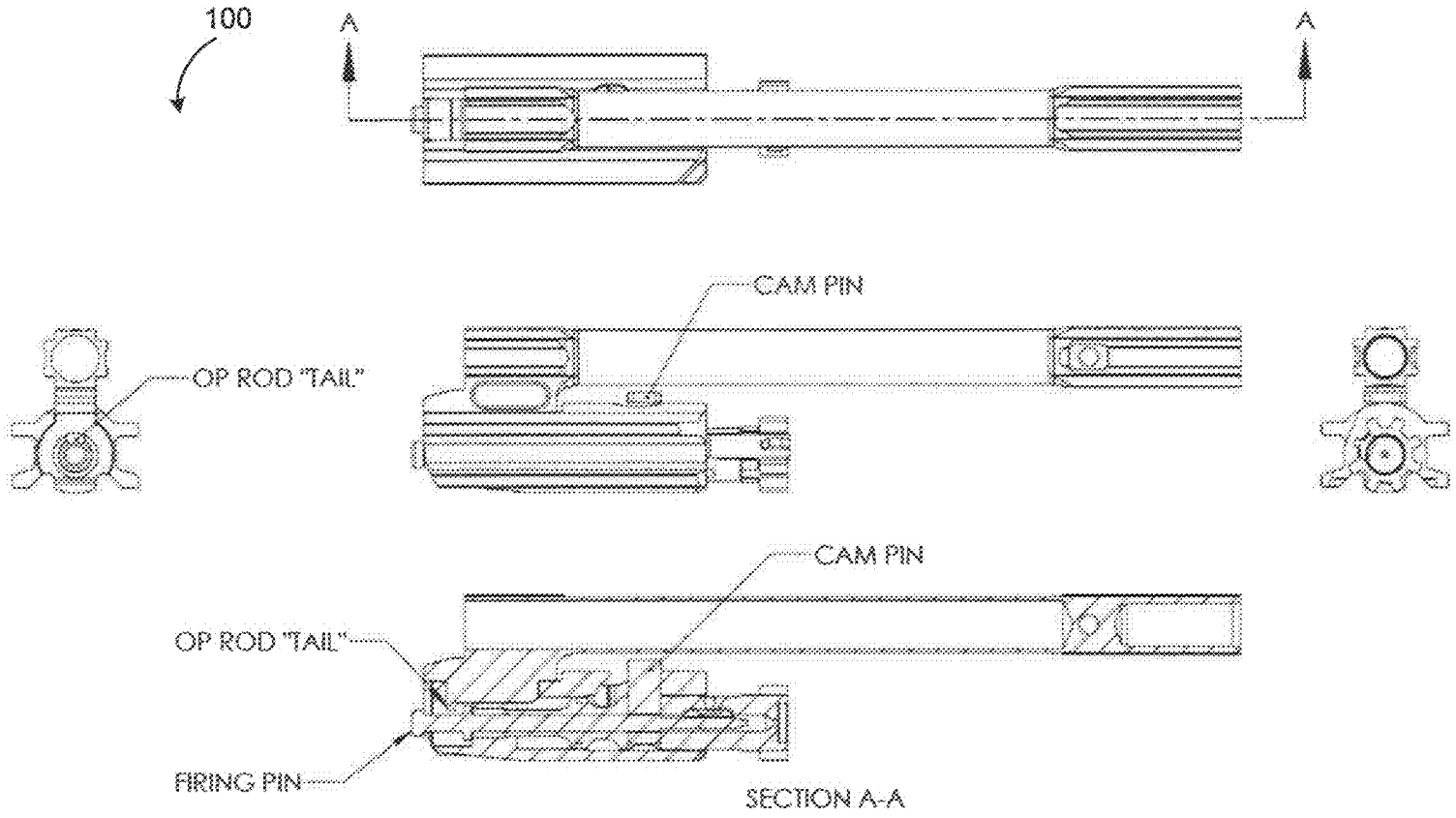
FIG. 2 illustrates various other views of the firearm gas operated autoloading system 100 of FIG. 1.

FIG. 2 illustrates various other views of the firearm gas operated autoloading system 100 of FIG. 1.

Figure 3:
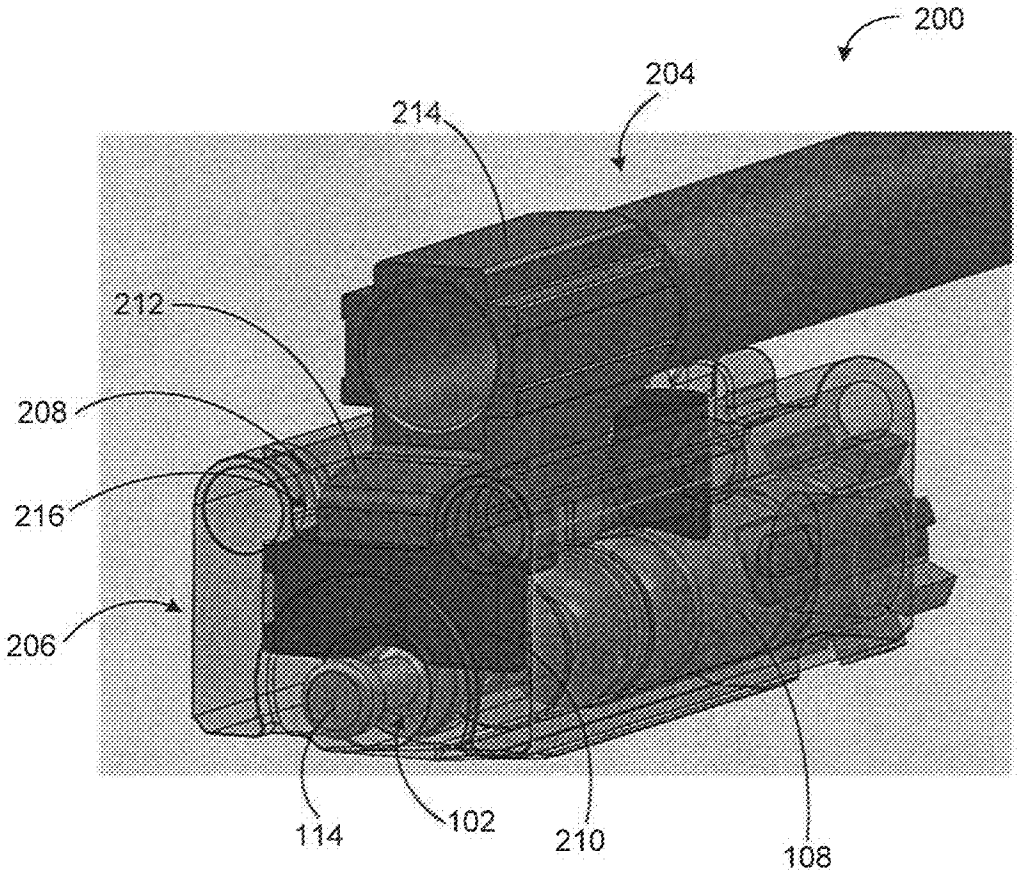
FIG. 3 illustrates a perspective view of another firearm gas operated autoloading system 200, according to an embodiment.

FIG. 3 illustrates a perspective view of another firearm gas operated autoloading system 200, according to an embodiment. An operating rod 204 includes a lug that is configured to interface with a recess 216 in a bolt carrier 206. The bolt carrier 206 defines a slot 208 positioned transversely to the recess 216, and the slot 208 extends below the recess 216. An elongate firing pin retainer 210 is sized to be received by the slot 208 and contact the second end 114 of the firing pin 102 so as to retain the firing pin 102 when the firearm gas operated autoloading system 200 is assembled. The bolt 108 and firing pin 102 are assembled into the bolt carrier 206 in substantially the same manner as described with respect to FIGS. 1-2. The firing pin retainer 210 is slidably inserted into the slot 208, and can be freely moved up and down until the operating rod 204 is assembled to the bolt carrier 206. After assembling the operating rod 204 to the bolt carrier 206, the firing pin retainer 210 is secured in place. Assembled as described, the firing pin retainer 210 (and hence the firing pin 102) can be easily removed from the firearm gas operated autoloading system 200 after removing the operating rod 204 from the bolt carrier 206.

It should be noted that the term "exemplary" and variations thereof, as used herein to describe various embodiments, are intended to indicate that such embodiments are possible examples, representations, and/or illustrations of possible embodiments (and such terms are not intended to connote that such embodiments are necessarily extraordinary or superlative examples).

It is important to note that the construction and arrangement of the system as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A firearm operating system, comprising:

a firing pin comprising a first end and a second end;

an operating rod assembly, comprising:

an operating rod, a lug positioned at a first end of the operating rod, and a firing pin retainer extending from the lug;

a bolt carrier, comprising:

a bolt carrier pocket structured to receive the firing pin retainer of the operating rod assembly, and a bolt carrier cam pin opening;

a bolt structured to be received in the bolt carrier, the bolt comprising a bolt cam pin opening; and a cam pin comprising a firing pin opening, the cam pin structured to be positioned through the bolt carrier cam pin opening and into the bolt cam pin opening, wherein the first end of the firing pin extends through the firing pin opening of the cam pin to retain the cam pin, wherein the firing pin retainer of the operating rod assembly engages the second end of the firing pin so as to retain the firing pin, and wherein a chambered round is fired in response to a hammer striking the firing pin and the firing pin retainer does not interfere with the hammer striking the firing pin.

2. The firearm operating system of claim 1, wherein the operating rod assembly including the firing pin retainer is structured so as to retain the firing pin when the operating rod assembly is coupled to at least one of the bolt and the bolt carrier, and wherein the operating rod assembly including the firing pin retainer is structured such that the firing pin is not retained when the operating rod assembly is decoupled from the at least one of the bolt and the bolt carrier.

3. The firearm operating system of claim 1, wherein the firearm operating system is structured such that the firing pin is removable without requiring further manipulation of the firearm operating system in response to the operating rod assembly being decoupled from at least one of the bolt and the bolt carrier.

4. A firearm operating system, comprising:

a firing pin comprising a first end and a second end;

an operating rod assembly, comprising:

an operating rod, a lug positioned at a first end of the operating rod; and a bolt comprising a bolt pocket structured to receive the lug of the operating rod assembly, wherein the lug engages a firing pin retainer located at the second end of the firing pin so as to retain the firing pin, wherein the operating rod, the lug, and the firing pin retainer comprise a unitary body.

5. The firearm operating system of claim 4, further comprising a firing pin retainer extending from the lug, the bolt pocket structured to receive the firing pin retainer, the firing pin retainer engaging the second end of the firing pin so as to retain the firing pin.

6. The firearm operating system of claim 4, further comprising a bolt carrier, the bolt carrier comprising a bolt carrier pocket structured to receive the lug of the operating rod assembly.

7. The firearm operating system of claim 6, further comprising:

a cam pin comprising a firing pin opening; and a bolt carrier cam pin opening defined by the bolt carrier, the cam pin structured to be positioned through the bolt carrier cam pin opening.

8. A firearm operating system, comprising:

a firing pin comprising a first end and a second end;

an operating rod assembly, comprising:

an operating rod; and a tail extending below a first end;

a bolt carrier defining a recess and a slot, the slot being positioned transverse to the recess and extending vertically from a top surface of the bolt carrier, the recess configured to receive the tail;

an elongate firing pin retainer sized to be slidably received by the slot and vertically movable within the slot, and configured so as to not interfere with a hammer when the hammer strikes the firing pin;

wherein the tail contacts the elongate firing pin retainer when the recess receives the tail, the elongate firing pin retainer engaging the second end of the firing pin so as to retain the firing pin.

9. A firearm operating system, comprising:

a firing pin comprising a first end and a second end;

an operating rod assembly, comprising:

an operating rod; and a tail extending below a first end;

a bolt carrier defining a recess and a slot, the slot being positioned transverse to the recess, the recess configured to receive the tail;

an elongate firing pin retainer sized to be slidably received by the slot and configured so as to not interfere with a hammer when the hammer strikes the firing pin;

wherein the tail contacts the elongate firing pin retainer when the recess receives the tail, the elongate firing pin retainer engaging the second end of the firing pin so as to retain the firing pin, wherein the tail portion defines a substantially flat bottom, and wherein the substantially flat bottom contacts the elongate firing pin retainer when the recess receives the tail.

10. The firearm operating system of claim 9, wherein the substantially flat bottom prevents removal of the elongate firing pin retainer from the bolt carrier.

* * * * *